US008356392B2

(12) United States Patent
Jackson

(10) Patent No.: US 8,356,392 B2
(45) Date of Patent: Jan. 22, 2013

(54) CREMATION CONTAINER

(76) Inventor: Terry Jackson, Tupelo, MS (US)

( * ) Notice: Subject to any disclaimer, the term of this patent is extended or adjusted under 35 U.S.C. 154(b) by 0 days.

(21) Appl. No.: 12/821,361

(22) Filed: Jun. 23, 2010

(65) Prior Publication Data

US 2011/0314647 A1 Dec. 29, 2011

(51) Int. Cl.
*A61G 17/00* (2006.01)

(52) U.S. Cl. ..... 27/4; 229/199.1

(58) Field of Classification Search ..... 27/4, 2, 27/1; 229/199.1, 117, 183, 185.1, 199; 220/9.2, 220/9.1, 6
See application file for complete search history.

(56) References Cited

U.S. PATENT DOCUMENTS 2,481,855 A * 9/1949 McKenzie ..... 206/446
5,307,545 A * 5/1994 Stoltz ..... 27/4
5,454,141 A * 10/1995 Ozbun et al. ..... 27/4
5,740,592 A * 4/1998 Lau ..... 27/4
5,771,548 A * 6/1998 Jenkins ..... 27/2
5,771,549 A * 6/1998 Saaf ..... 27/4
5,815,898 A * 10/1998 Jenkins ..... 27/4
6,105,220 A * 8/2000 Belanger ..... 27/4
6,317,944 B1 * 11/2001 Beaulieu et al. ..... 27/4
6,640,401 B2 * 11/2003 Chen et al. ..... 27/4

FOREIGN PATENT DOCUMENTS

DE 2608058 A * 9/1977

* cited by examiner

*Primary Examiner* — William L. Miller
(74) *Attorney, Agent, or Firm* — Wyatt, Tarrant & Combs, LLP; William S. Parks

(57) ABSTRACT

A cremation container may comprise a cover and a base. The base may comprise a corrugated fiberboard portion and a frame. The corrugated fiberboard portion may encase the frame and may form a bottom of the base. Consequently, the base may be provided with a combined structural strength of both the frame and corrugated fiberboard portion.

10 Claims, 3 Drawing Sheets

CREMATION CONTAINER

BACKGROUND OF THE INVENTION

The present invention generally relates to cremation containers and more particularly to cremation containers constructed principally from corrugated fiberboard material.

It is common practice in the mortuary industry to use corrugated fiberboard containers to enclose a body for cremation. In some instances the corrugated fiberboard container may be used to support a body for viewing prior to cremation. In this context it is desirable that such containers be strong enough to withstand lifting and moving a body within the container without bending or distortion of the container. It is also desirable that such a container is inexpensive but nevertheless has a pleasing aesthetic appearance, particularly if viewing prior to cremation is contemplated.

As can be seen, there is a need for a strong cremation container which may be constructed principally from corrugated fiberboard material.

SUMMARY OF THE INVENTION

In one aspect of the present invention, a cremation container may comprise: a base for supporting remains to be cremated; and a cover for covering the remains; wherein the base comprises: a corrugated fiberboard portion; and a frame; and wherein the corrugated fiberboard portion encases the frame and forms a bottom of the base.

In another aspect of the present invention, a base for a cremation container may comprise: a wood frame; and a corrugated fiberboard portion; wherein the fiberboard portion comprises; a corrugated fiberboard bottom for the base; and a corrugated fiberboard encasement for the frame.

In still another aspect of the invention, a method for making a base for a cremation container may comprise the steps of: constructing a combustible frame in a desired shape of the base; placing the frame on a sheet of corrugated fiberboard material; folding the corrugated fiberboard material around the frame so that the materials forms a bottom for the base and an encasement of the frame.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide cremation containers with bases constructed from corrugated fiberboard material folded around a supporting frame.

Figure 1:
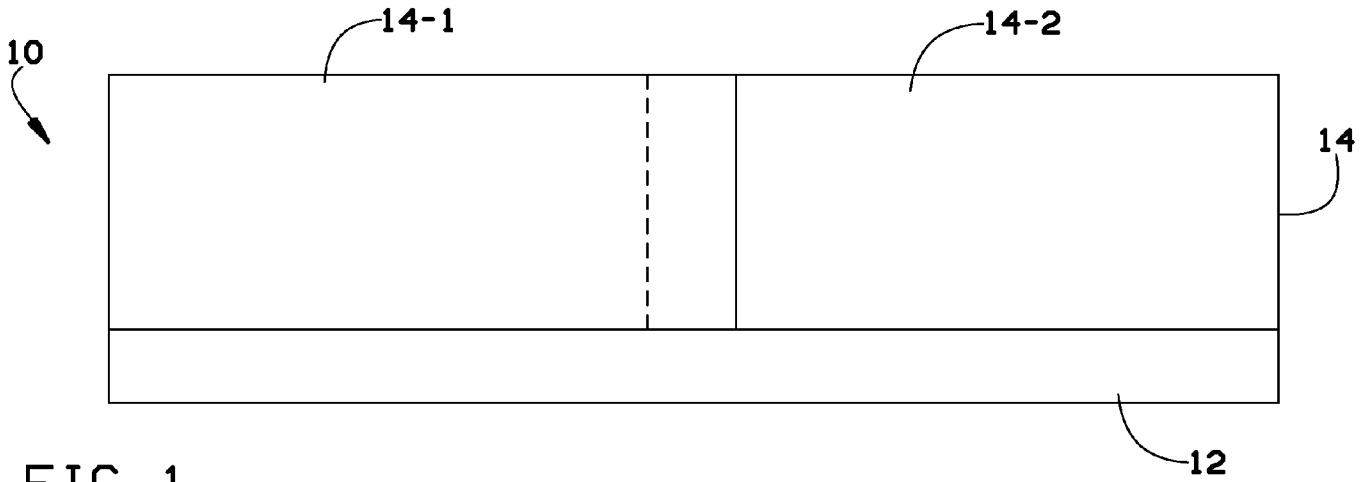
FIG. 1 is an elevation view of a cremation container in accordance with an embodiment of the invention.
Figure 2:
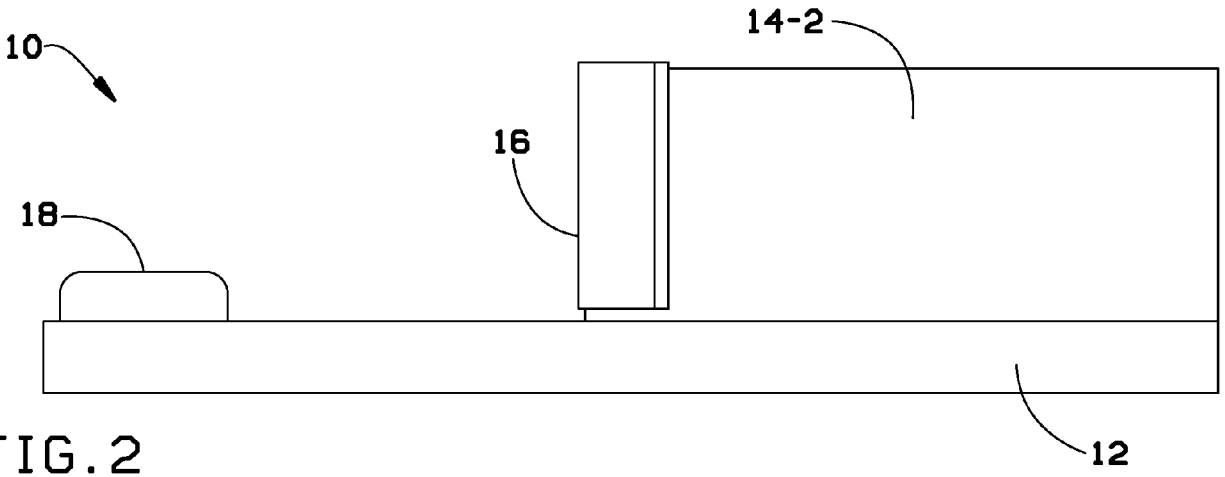
FIG. 2 is an elevation view of an open cremation container in accordance with an embodiment of the invention.

Referring now to FIGS. 1 and 2, a cremation container 10 may comprise a base 12 and a cover 14. In an exemplary embodiment of the invention, the cover 14 may comprise a lower section 14-2 and an upper section 14-1. The upper section 14-1 may be removed from the cremation container 10 if the container 10 is used in a viewing of the remains (not shown). As shown in FIG. 2, during a viewing, a portion of the lower section 14-2 may be provided with an aesthetic fabric covering 16 and a pillow 18 may be provided on the base 12.

Figure 3:
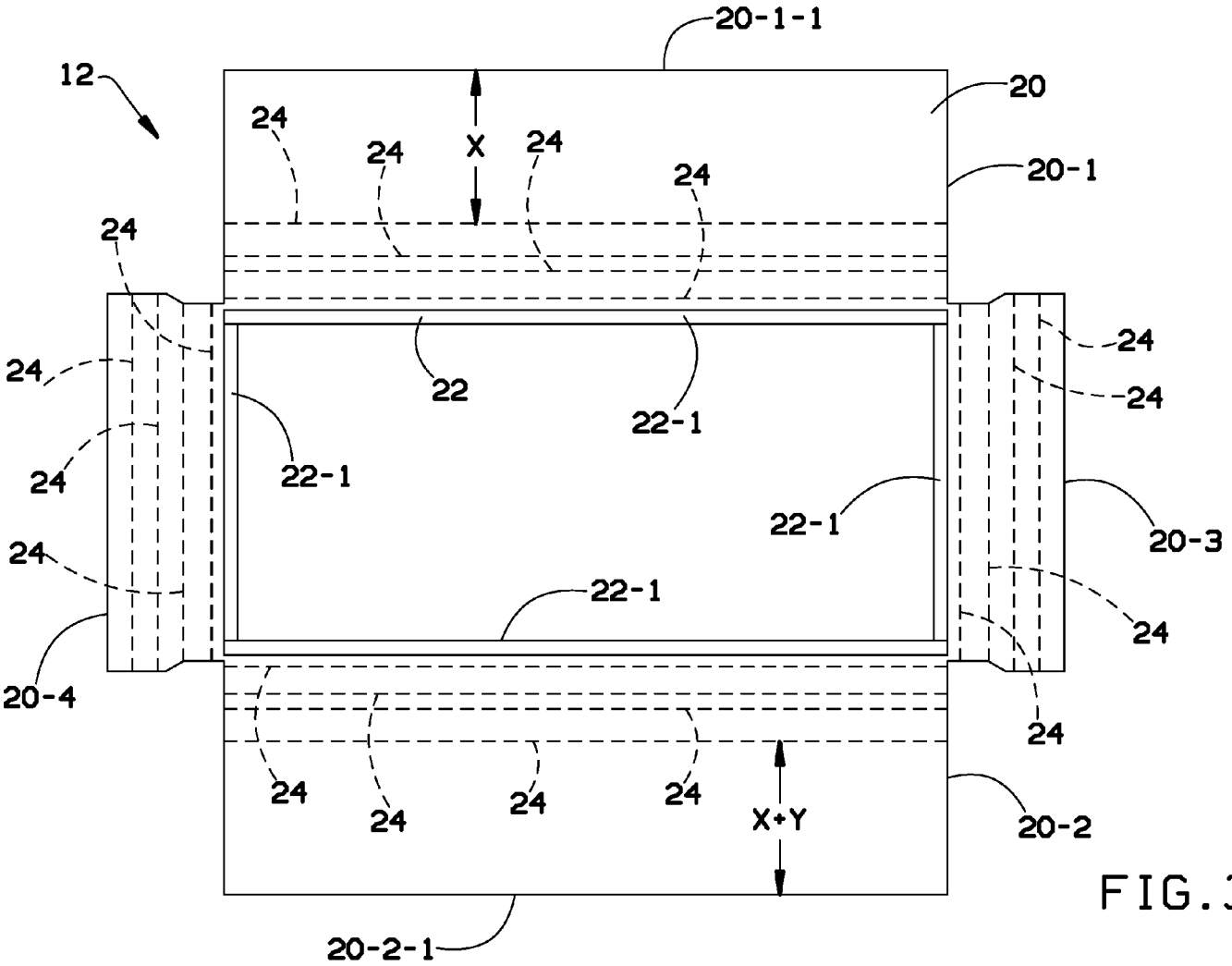
FIG. 3 is a plan view of an unassembled base of the cremation container of FIG. 1 in accordance with an embodiment of the invention.
Figure 4:
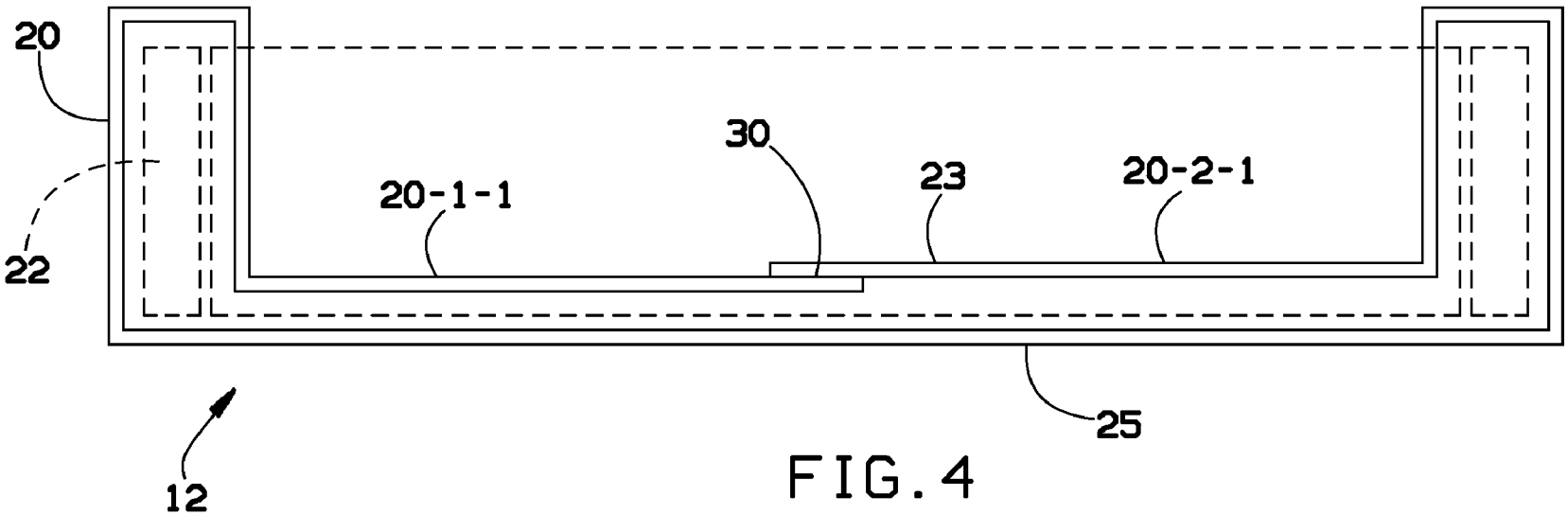
FIG. 4 is a partial cross sectional view of the base of FIG. 3 in accordance with an embodiment to the present invention.

Referring now to FIGS. 3 and 4, the base 12 may be seen in disassembled form (FIG. 3) and in an assembled form (FIG. 4). A corrugated fiberboard portion 20 of the base 12 may be configured as shown in FIG. 3. A frame 22 may be positioned on the corrugated fiberboard portion 20. The corrugated fiberboard portion 20 may be provided with scorings 24 along which the portion 20 may be folded so that the frame 22 may be encased by corrugated fiberboard material as shown in FIG. 4.

The corrugated fiberboard portion 20 may be sequentially folded over the frame 22. A first length segment 20-1 may be folded first so that a first bottom portion 20-1-1, with a width x, may cover a first portion of an interior bottom 23 of the base 12. A second length segment 20-1 may be folded so that a second bottom portion 20-2-1, with a width x plus y, may cover a second portion of the interior bottom 23 of the base 12 and so that the portion 20-2-1 may partially overlap the portion 20-1-1. An adhesive strip 30 may join the overlapped areas. Length segments 20-1 and 20-2 may be folded into the base 12 after end segments 20-3 and 20-4 are in place. When folding is complete, the corrugated fiberboard portion 20 may provide both the interior bottom 23 and an exterior bottom 25 for the base 12.

In an exemplary embodiment, the frame 22 may comprise strips 22-1 of combustible material (e.g., wood) with a width of about 4 inches and a thickness of about 1 inch. The Corrugated fiberboard portion may be comprised of 350 pound corrugated fiberboard. The fiberboard portion 20 may be attached to the frame 22 by folding the fiberboard onto the frame 22.

It may be noted that the frame-and-corrugated fiberboard structure of the present invention will provide superior strength and stiffness usually associated with prior art cremation containers made from 500 pound corrugated fiberboard material with a plywood bottom insert.

It should be understood, of course, that the foregoing relates to exemplary embodiments of the invention and that modifications may be made without departing from the spirit and scope of the invention as set forth in the following claims.

I claim:

1. A cremation container comprising:

a base for supporting remains to be cremated, wherein said base has both an interior bottom and an exterior bottom; and a cover for covering the remains;

wherein the base comprises:

a corrugated fiberboard portion; and a frame including four members extending in rectangular fashion around the entire perimeter of said base;

wherein the corrugated fiberboard portion encases the entire frame and simultaneously forms both said interior bottom and said exterior a bottom of the base; and wherein said interior bottom and said exterior bottom are two distinct layers of said corrugated fiberboard.

2. The cremation container of claim 1 wherein the corrugated fiberboard portion is a single piece of material.

3. The cremation container of claim 1 wherein the frame is combustible material.

4. The cremation container of claim 3 wherein the frame is comprised of wood strips having a width of about 4 inches and thickness of about 1 inch.

5. A cremation container base including an interior bottom and an exterior bottom, said base comprising:

a wood frame including four members extending in rectangular fashion around the entire perimeter of said base; and a corrugated fiberboard portion secured to said frame;

wherein the fiberboard portion encases the entire frame and simultaneously provides both said interior bottom and said exterior bottom for said base;

wherein said interior bottom and said exterior bottom are two distinct layers of said corrugated fiberboard; and said base adapted to support remains to be cremated.

6. The cremation container base of claim 5 wherein the fiberboard portion is secured to the frame by folding the corrugated material around the frame.

7. The cremation container base of claim 5 wherein the corrugated fiberboard portion comprises a single sheet of corrugated fiberboard material which is scored so that, when folded, the material forms said interior bottom of the base, said exterior bottom of the base and said encasement for said frame.

8. A method of making a cremation container base comprising the steps of:

constructing a four-membered rectangular frame of combustible material in a shape of the base;

placing the frame on a sheet of corrugated fiberboard material;

folding the corrugated fiberboard material around the frame so that the material forms a bottom for the base and an encasement for the frame, wherein said fiberboard is folded over said frame to be in contact with itself in such a fashion as to provide two distinct layers of said corrugated fiberboard forming an interior bottom and an exterior bottom for said base; and said base adapted to support remains to be cremated.

9. The method of claim 8 wherein the step of folding produces both said exterior bottom of the base and said interior bottom of the base.

10. The method of claim 8 further comprising the step of folding the corrugated fiberboard material onto the frame so that the base is provided with combined structural strength of both the frame and the corrugated fiberboard encasement.

* * * * *